US008820545B2

(12) United States Patent
Kologe

(10) Patent No.: US 8,820,545 B2
(45) Date of Patent: Sep. 2, 2014

(54) POSITION LOCK FOR PRODUCT DISPLAY RACK

(75) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 348 days.

(21) Appl. No.: 13/360,170

(22) Filed: Jan. 27, 2012

(65) Prior Publication Data

US 2012/0211450 A1 Aug. 23, 2012

Related U.S. Application Data

(60) Provisional application No. 61/443,913, filed on Feb. 17, 2011.

(51) Int. Cl.
*A47F 1/04* (2006.01)
*A47F 1/12* (2006.01)

(52) U.S. Cl.
CPC ..... *A47F 1/126* (2013.01)
USPC ..... 211/59.3

(58) Field of Classification Search
CPC ..... A47F 1/125–1/128
USPC ..... 211/59.3, 51, 184; 248/410, 297.51
See application file for complete search history.

(56) References Cited

U.S. PATENT DOCUMENTS

| | | | | |
|---|---|---|---|---|
| 538,500 | A * | 4/1895 | Buckley | 211/51 |
| 1,674,359 | A * | 6/1928 | Frey | 211/51 |
| 3,966,050 | A * | 6/1976 | Dahl | 211/10 |
| 4,343,450 | A * | 8/1982 | Anderson | 248/454 |
| 5,450,969 | A * | 9/1995 | Johnson et al. | 211/59.3 |
| 5,671,851 | A * | 9/1997 | Johnson et al. | 211/51 |
| 6,745,906 | B1 | 6/2004 | Nagel | |
| 6,866,155 | B2 | 3/2005 | Nagel | |
| 6,886,700 | B2 | 5/2005 | Nagel | |
| 6,889,855 | B2 | 5/2005 | Nagel | |
| 7,293,663 | B2 * | 11/2007 | Lavery, Jr. | 211/59.3 |

* cited by examiner

*Primary Examiner* — Korie H Chan
(74) *Attorney, Agent, or Firm* — St. Onge Steward Johnston & Reens LLC

(57) ABSTRACT

A locking mechanism is provided for a product display tray of the type having a base formed of longitudinal wires and having a product pusher slideable on the wires and urged forwardly by a spring to maintain products at the front of the tray as items are removed by customers. A locking member is positioned to slide on the wires and is pushed forwardly by the spring. The locking member has angled edges which engage the wires when the element is tilted. When the pusher is moved toward the rear of the tray, the geometry of the pusher causes it to tilt the locking member such that its angled edges lock onto the wires, preventing the spring from moving the pusher forward during loading of the tray. Pressing rearward at the top of the pusher reorients the locking member and frees the pusher to be moved forward by the spring.

12 Claims, 7 Drawing Sheets

POSITION LOCK FOR PRODUCT DISPLAY RACK

CROSS-REFERENCE TO RELATED APPLICATIONS

The present application claims the benefit under 35 U.S.C. §119(e) of the U.S. Provisional Patent Application Ser. No. 61/443,913, filed on Feb. 17, 2011, the content of which is incorporated herein by reference.

FIELD OF THE INVENTION

The present invention relates to trays for the display of merchandise in supermarkets and other stores and particularly to merchandise display trays comprising a base formed of longitudinally extending wires for supporting the merchandise and slideably mounting a pusher member to urge a column of products forwardly as individual packages are removed from the front of the display.

BACKGROUND OF THE INVENTION

In the display of merchandise in stores and supermarkets, it is important that the products be presented in a neat and orderly manner, with the front packages of a partly depleted column thereof positioned at the front of the display, where they are easily seen and accessed by customers. For this purpose, it is common to utilize display trays provided with spring-actuated pushers that automatically push forward on a column of packages and serve to advance the entire column forwardly each time a package is removed from the front of the display.

In order to re-stock a tray having a spring actuated pusher, the pusher first must be pushed to the rear of the tray and held there while the tray is reloaded. With trays constructed of plastic materials, this can conveniently be done by molding a notch or the like into the back of the tray to engage the retracted pusher and hold it until released by the store personnel after reloading the tray. However, trays formed with wire bases are in widespread and increasing usage because of cost and certain functional advantages, particularly in connection with refrigerated displays. One potential disadvantage of wire base trays, however, lies in comparative difficulty of locking the spring-loaded pusher in a retracted position during restocking. One known technique involves mounting a latching device at the back of the pusher which automatically latches to the back of the tray when the pusher is fully retracted for loading. However, to a large and increasing extent, supermarkets are using very tight planograms for the display of merchandise, with very little space above or at the sides of the trays, at the back. Accordingly, it can be very difficult, and sometimes impossible, to reach to the back of the display to release a latch device after the tray has been loaded with merchandise, because of tightly packed adjacent trays and little overhead clearance. Moreover, the latching device does not function to hold the tray in an intermediate position, which can be desired in certain instances.

SUMMARY OF THE INVENTION

The present invention is directed to a novel, simplified and economical arrangement for locking of a spring-loaded pusher at the back of a wire tray, in a manner that renders the release of the pusher of a reloaded tray both quick and easy and, in many cases, an automatic result of completion of the reloading procedure. The invention is particularly applicable to merchandise display trays in which the base is comprised of a plurality of longitudinally extending wires which support the product and also slideably mount a pusher, typically of plastic material, which is of inverted Y-shaped or V-shaped configuration having spaced apart front and back panels. A locking member is associated with one of the panels, preferably the front panel, and is formed with a slot or opening to embrace one or more wires of the base. The slot is formed with sharp edges which, when the locking member is disposed at an appropriate angle with respect to the wires embraced thereby, lockingly engage the embraced wire or wires and lock the locking member in its then position, typically at or near the back of the tray. The return spring normally acts on the front panel of the pusher to urge the pusher forwardly on the tray. However, in the arrangement of the invention, the spring acts on the pusher through the locking member such that, when the locking member is locked in position on the wire base, there is no forward spring force acting on the pusher, which thus remains in its retracted position for reloading of the tray.

When reloading has been completed, the locking member is tilted back to its normal position, in which its locking edges no longer grip the tray wires. The locking member is then free to move, and is urged forwardly by the spring, along with the pusher, advancing the products to the front of the tray. With the system of the invention, re-tilting of the locking member to its normal position can be effected from the front of the tray, by momentarily pushing rearward at the front of the column of packages. Moreover, in a particularly preferred embodiment of the invention, when the tray is refilled to capacity, insertion of the last package will automatically push backward on the pusher enough to cause the locking member to be tilted to a release position and thus automatically return the tray to normal operation.

In various embodiments of the invention, the locking member can be movable separately from the product pusher or alternatively fixed to one of the panels of the pusher.

For a more complete understanding of the above and other advantageous features of the invention, reference should be made to the following Detailed Description of the Invention, and to the accompanying drawings described below.

DETAILED DESCRIPTION OF THE INVENTION

Figure 1:
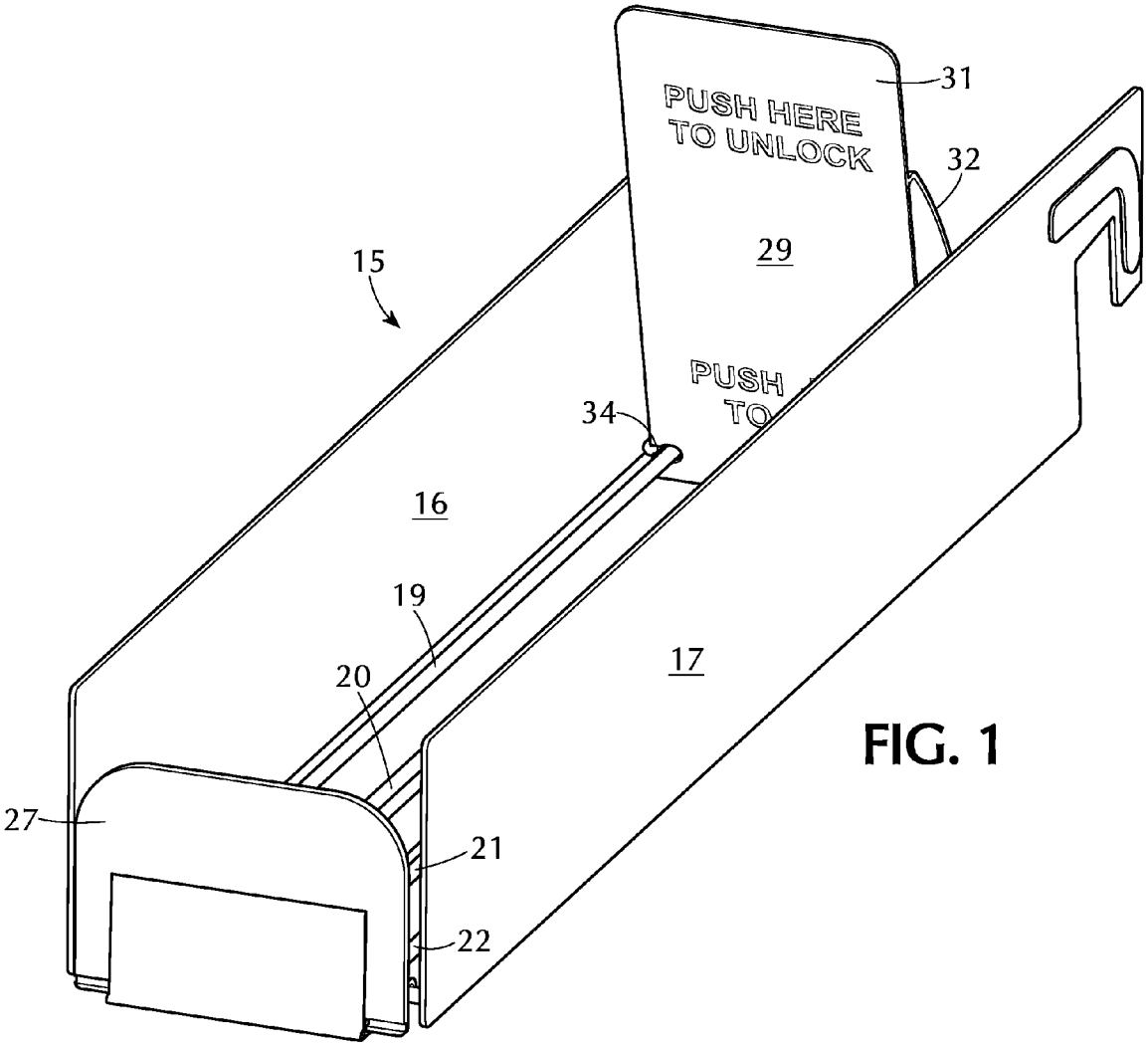
FIG. 1 is a perspective view of an advantageous form of product display tray incorporating features of the invention.
Figure 6:
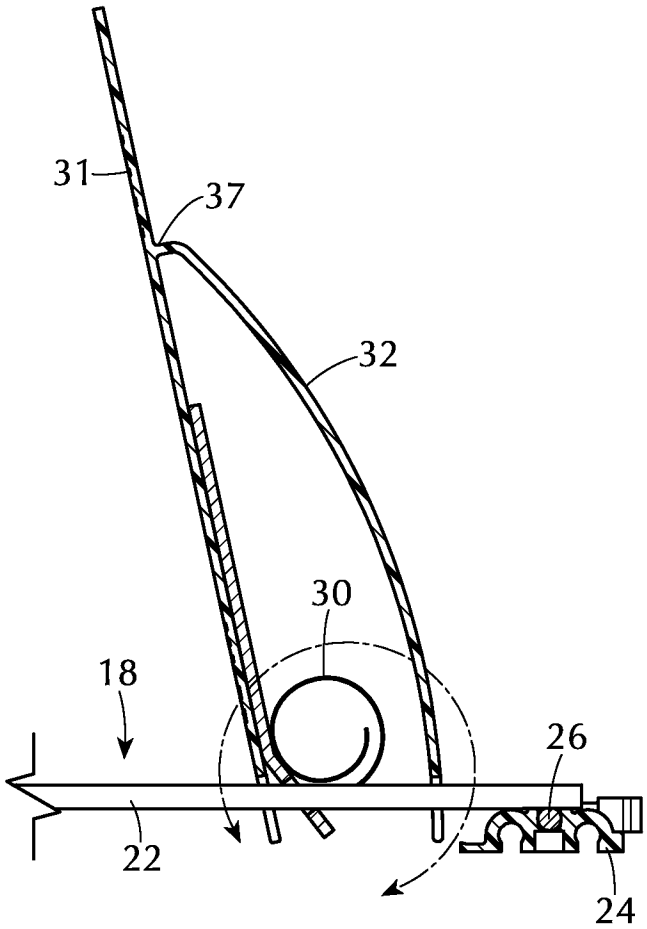
FIG. 6 is a fragmentary cross sectional view similar to that of FIG. 5, but illustrating the pusher and locking member in a locked configuration.
Figure 5:
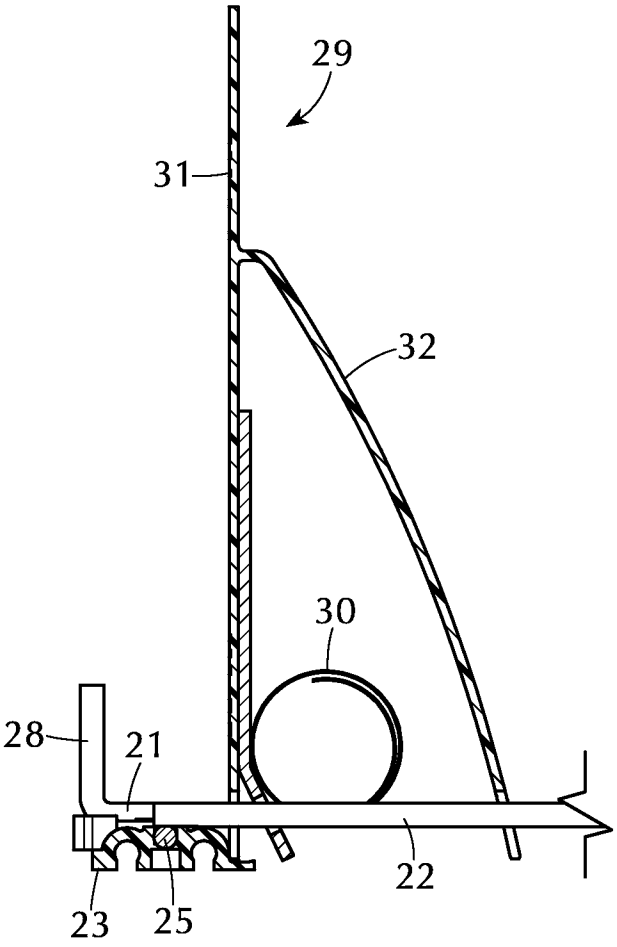
FIG. 5 is a fragmentary cross sectional view as taken generally on line 5-5 of FIG. 2, showing portions of a tray, with a pusher and locking member in normal, unlocked configuration.

Referring now to the drawings, FIG. 1 shows an advantageous form of product display tray 15 suitable for cantilever mounting on a square bar. The tray 15 comprises a pair of laterally spaced and typically laterally adjustable side plates 16, 17 positioned on opposite sides of a product supporting base 18. The base 18 is comprised of laterally spaced, longitudinally extending wires 19-22 supported at each end by base supports 23, 24 (FIGS. 5, 6). The longitudinal wires 19-22 are joined at each end to cross bars 25, 26 which extend underneath and are secured in upwardly opening grooves in the supports 23, 24. A front barrier 27 is mounted on vertically extending portions 28 of the central base wires 20, 21. An advantageous form of display tray of the type referred to above is shown and described in the copending application of Thomas O. Nagel et al, Ser. No. 12/354,398, filed Jan. 15, 2009, the disclosure of which is incorporated herein by reference.

A product pusher 29 is slideably supported on the wires 19-22 of the base and is urged in a forwardly direction by a coiled strip spring 30. In the illustrated arrangement, the product pusher is an extruded shape of suitable plastic material and comprises a normally flat, normally upright front panel 31 and a back panel 32 which is integrally joined with the front panel and extends rearwardly and downward therefrom. In the illustrated pusher, the back panel 32 joins the front panel at a junction level located a short distance (e.g., 30% of the height of the front panel) below the top edge of the front panel, forming somewhat of an inverted Y-shaped cross sectional configuration. However, the front and back panels can be joined at the upper edges of both, in an inverted V-shaped cross section, if desired. Likewise, in the illustrated embodiment of the invention the product pusher is formed of a plastic material, with the front and back panels being integrally joined and having a flexible relationship. However, in theory, the front and back panels could be formed of relatively non-flexible materials hingedly joined to each other.

Figure 4:
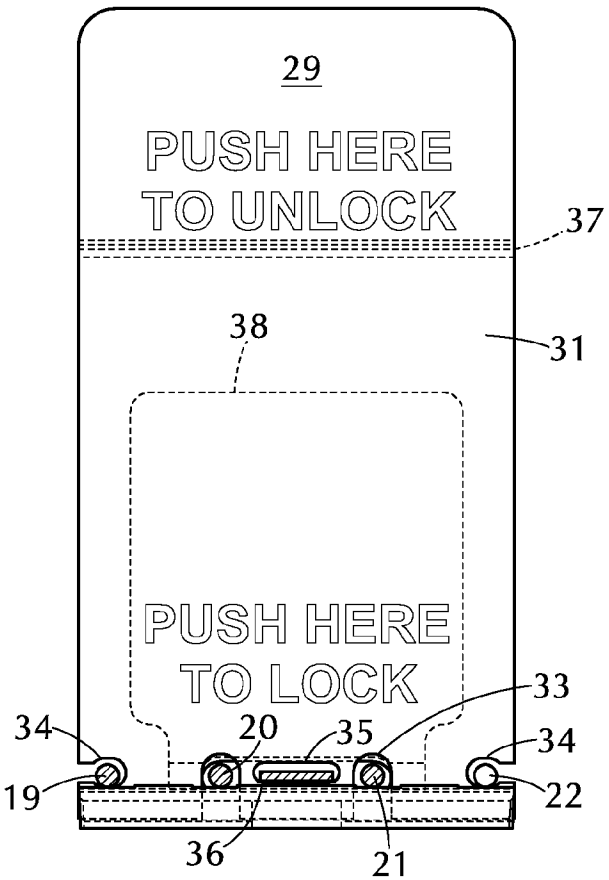
FIG. 4 is a cross sectional view as taken generally on line 4-4 of FIG. 3.
Figure 2:
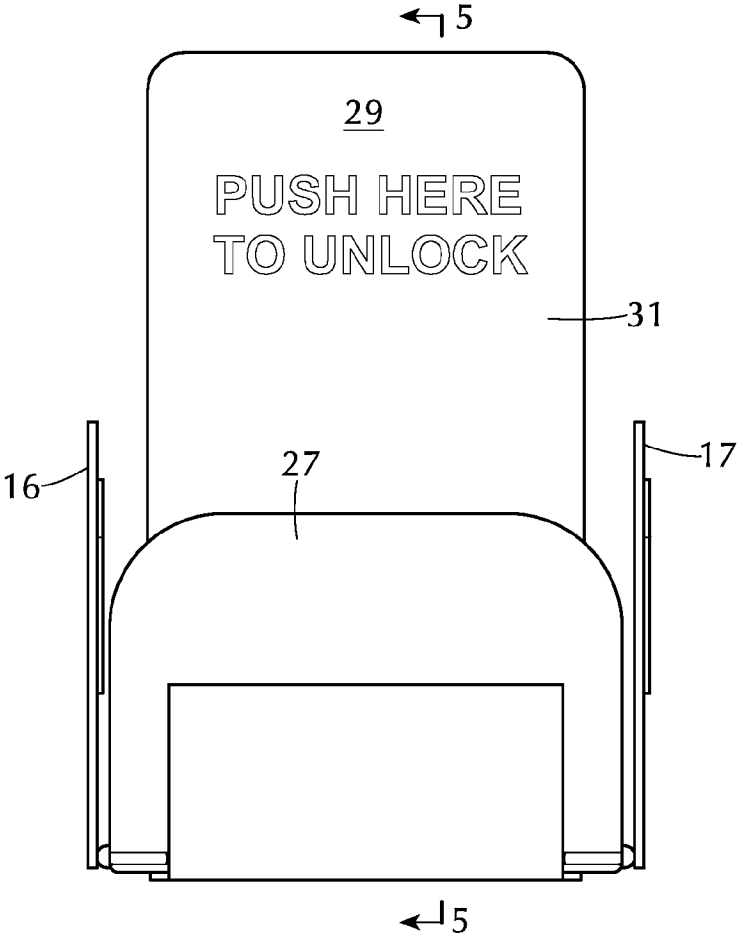
FIGS. 2 and 3 are front and side elevational views, respectively, of the tray of FIG. 1.
Figure 3:
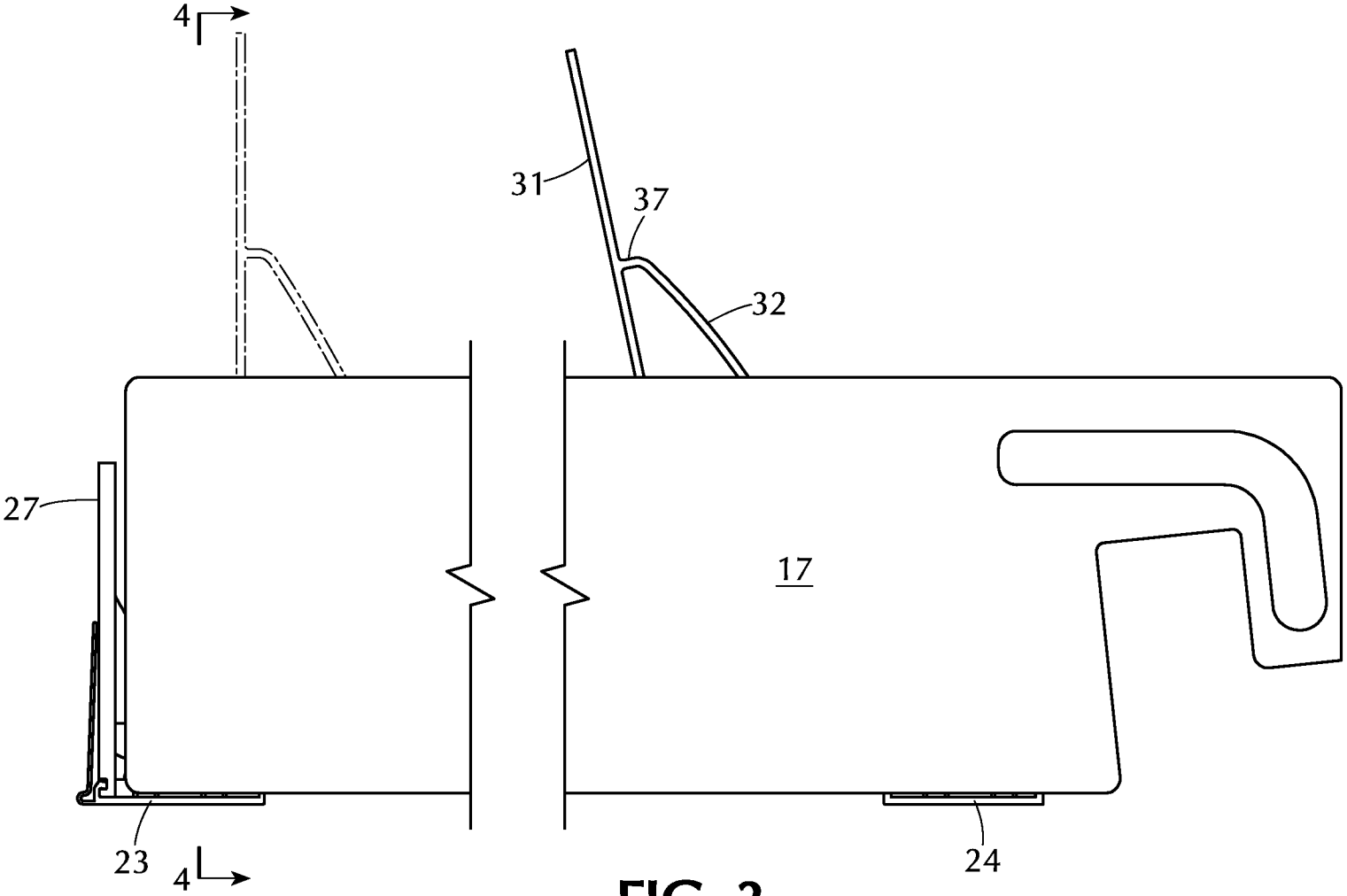

As shown in FIG. 4, the front and back pusher panels 31, 32 are formed with two downwardly opening notches 33 to receive the center base wires 20, 21, and with two laterally opening notches 34 to receive the outside wires 19, 22. These notches retain the pusher on the wire base while allowing the pusher to slide forward by action of the spring 30 and to be manually slid rearwardly for loading of packages into the tray. The front pusher panel 31 is also formed with a horizontal slot 35 between the central notches 33, which accommodates and confines a forwardly extending strip 36 of the spring 30, which is attached to the base 18, typically at the front support 23.

As shown in FIGS. 5 and 6, the length of the pusher back panel 32, from its junction level 37 with the front panel 31 to the wires 19-22, is greater than the length of the front panel 31 from the junction level 37 to the level of the wires. Accordingly, if the bottom portions of the panels 31, 32 are resiliently squeezed together, as shown in FIG. 6, the front panel 31 is forced to tilt in a forwardly direction. This geometrical relationship is utilized to advantage in accordance with the present invention to provide a facility for locking the product pusher in a rearward position, while the tray is loaded with products, and for releasing the pusher for forward movement when loading has been completed.

Figure 8:
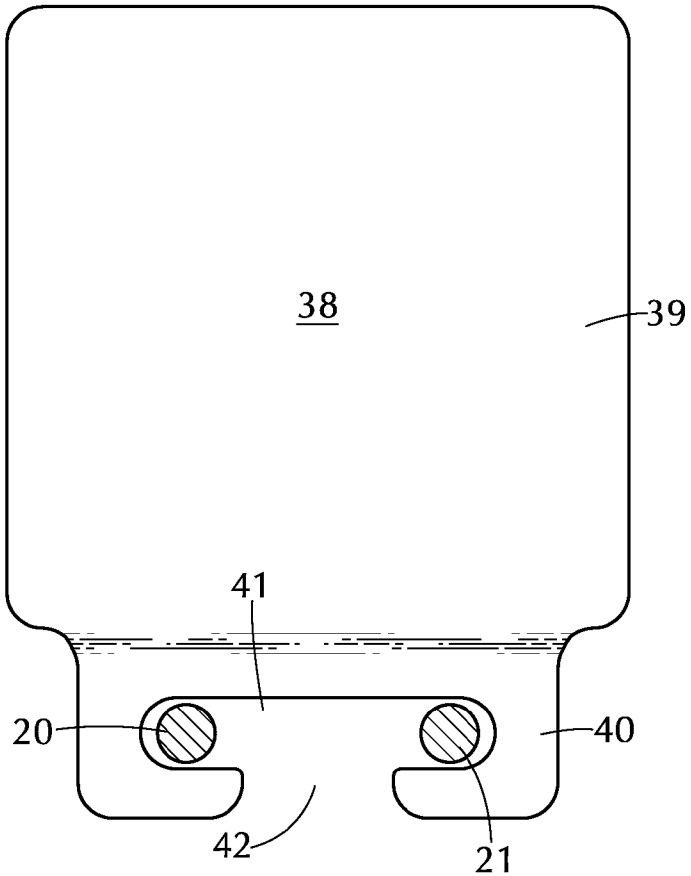
FIGS. 8 and 9 are front and side elevational views, respectively, of a locking member incorporated in the display tray of FIG. 1.
Figure 10:
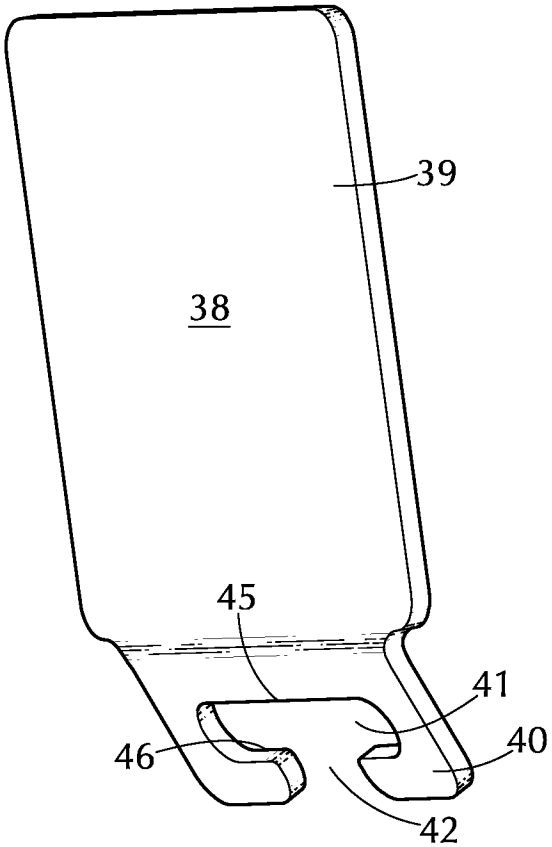
FIG. 10 is a perspective view of the locking member of FIGS. 8 and 9.
Figure 9:
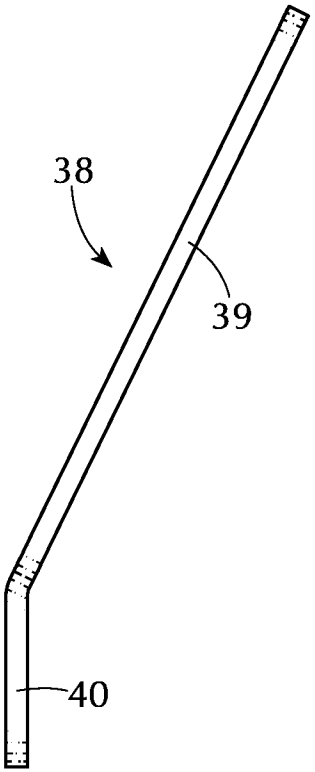

In a preferred form of the invention, the display tray is provided with a locking member 38, shown in FIGS. 8-10, preferably formed of steel or other correspondingly hard material. The locking member has an upper portion 39 and a lower portion 40 disposed at an angle to the upper portion. In a typical embodiment, the bend angle between the front surfaces of the upper and lower portions may be from about 26° to about 32°. However, as will be apparent hereinafter, these angles may be varied with other geometric factors, with the primary factor being that, when the locking member is moved to a tilted position, it will lock onto the base wires 20, 21 and function to retain the product pusher 29 in a rearwardly displaced position.

As shown in FIGS. 8 and 10, the lower portion 40 of the locking member is formed with a horizontally elongated slot 41, which is of a width to closely accommodate the two central wires 20, 21 of the base 18. The slot 41 has a downwardly opening entrance gap 42 of substantially less width than the slot itself. The width of the gap 42 is such that the locking member may be placed on the central wires 20, 21 by squeezing those wires and displacing them toward each other in an area between the front and back base supports 23, 24. The wires 20, 21, when so displaced, will fit through the gap 42, after which, when the wires are released, the locking member 38 is effectively retained on the wires.

Figure 7:
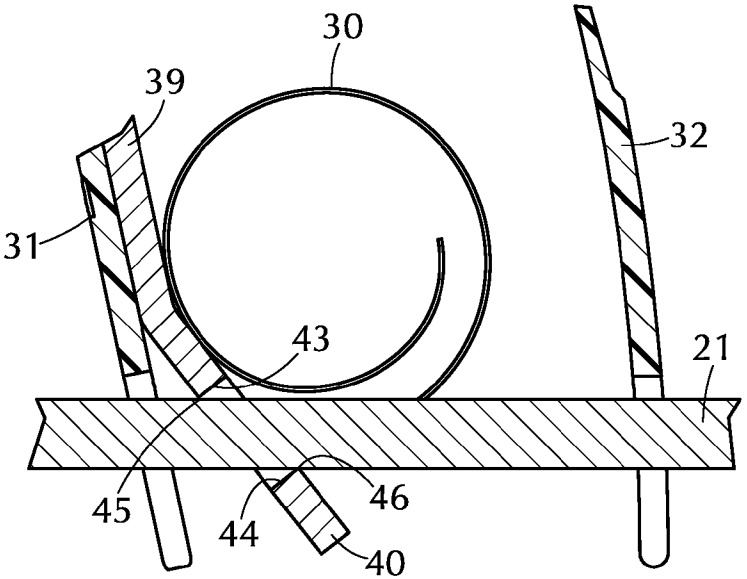
FIG. 7 is an enlarged, fragmentary cross sectional view of a portion of FIG. 6, showing details of the locking action of the locking member on the wires of the tray.

In the first illustrated form of the invention, the locking member is formed of stiff sheet metal, and the slot 41 is punched out of the metal of the lower portion 40, such that the axis of the opening is substantially perpendicular to the plane of the lower portion 40. The arrangement is such that the upper and lower walls 43, 44 of the slot 41 lie at a shallow angle to the wires 20, 21 when the upper portion 39 of the locking member 38 is in a generally vertical orientation, as shown in FIG. 5. However, when the upper portion 39 is tilted forwardly, as shown in FIGS. 6 and 7, the slot walls 43, 44 lie at a sharper angle to the wires, such that diagonally opposite upper and lower edges 45 and 46 of the slot are caused to dig into wires 20, 21 to prevent forward movement of the locking member under the pressure of the coil spring 30.

In a conventional display tray of the type shown herein, the coil spring 30 acts directly against the back of the pusher front panel 31, so that the product pusher 29 is at all times urged in a forwardly direction. In accordance with one aspect of the present invention, however, and as shown in FIGS. 5-7, the locking member 38 is interposed between the front of the coil spring 30 and the back wall of the pusher panel 31 such that, when the locking member is effectively locked onto the wires 20, 21, the pusher panel is isolated from the spring pressure and remains in a fixed position on the base 18 until the locking member is released.

In accordance with one aspect of the invention, the slot 41 has a height that is somewhat greater than the diameter of the wires 19-22. Accordingly, when the locking member is disposed in an upright position, as shown in FIG. 5, and even though the lower portion 40 thereof is disposed an an angle to the wires 19-22, there is sufficient clearance between the slot 41 and the wires to allow the locking member to slide freely along the wires. In an advantageous embodiment of the invention, intended for use in connection with trays having wires 19-22 of 0.148 inch diameter, the slot 41 in a locking member of 0.075 inch thick sheet steel has a height of 0.250 inch. When the locking member 38 is upright, the angled lower portion is tilted about 26° to the vertical, and the height of the slot 41 allows the locking member to slide freely. When the locking member is tilted about 10° forward (FIGS. 6, 7) diagonally opposite edges of the slot 41 engage the rods 21, 22 and effectively lock the element 38 is a fixed position.

For larger trays, for example using base wires of 0.177 inch diameter, the slot 41 is made with a greater height, for example of 0.300 inch. It may also be advantageous, in such cases, to form the locking member with a somewhat greater bend between the upper and lower portions 39, 40, for example about 32°. In either case the combination of wire diameter, slot height and angle of bend is intended to cause the corners 45, 46 to dig in and lock with the wires 20, 21 when the upper portion of the locking member is given a forward tilt of about 10° from the upright position shown in FIG. 5.

In normal operations of the tray, the front pusher panel 31 is substantially vertical, as shown in FIG. 8. The action of the coil spring 30 pressing forwardly on the locking member 38 causes the upper portion 39 of the locking member to be retained flat against the front pusher panel 31 and thus in an upright orientation in which the locking member, and thus the pusher 29 as well, slides freely on the wires 20, 21. For reloading of the tray with product packages, the user presses rearwardly on lower portions of the front panel 39 (i.e., well below the juncture level 37), causing the pusher 29 and the locking member to slide rearwardly on the base wires. When the pusher back panel 32 reaches the back support 24, the back panel is stopped. Continued pushing on the front panel causes the pusher 29 to tilt forwardly, as shown in FIGS. 6 and 7. After about 10° of forward tilt, the edges 45, 46 of the slot 41 engage and grip the wires 20, 21. Continued forward pressure by the coil spring 30 tends to retain the tilted orientation of the locking member to fix its position on the wires and isolate the force of the spring from the pusher 29, which accordingly remains locked in its retracted position until released.

In order to release the product pusher from its retracted and locked position, force can be applied to upper portions of the front pusher panel 31 to return that panel to an upright orientation. This in turn causes the locking member 38 to return to an upright orientation, as shown in FIG. 5, in which the slot edges 45, 46 no longer grip the wires. The release of the product pusher 29 can be done manually, by pushing rearward with a hand on an upper portion of the front pusher panel. Additionally, and to advantage, during the restocking of the tray, as the tray becomes filled to capacity with packages, the last package inserted will cause the front pusher panel to become upright on the base 18 and will thus automatically release the pusher for forward movement under the pressure of the spring 30. This is a particularly advantageous feature in that it enables a locked product pusher to be released from the front of the display, either automatically by filling the display to capacity with insertion of the last package, or by pressing rearwardly on the front of a column of packages. In either case, the column of packages is pressed against upper portions of the front panel 31 to push the panel to an upright position, releasing it for spring-pressed forward movement. It does not matter how tightly packed the display planogram may because the operator does not have to access the back of the display to release the locked pusher.

An advantageous feature of the invention is that the product pusher 29 may be locked in any intermediate position desired by the user and does not have to be retracted all the way to the back of the tray. As shown in the drawings, the forward pressure of coil spring 30 tends to seat the coil in the bottom of the Vee formed between the upper and lower portions 39, 40 of the locking member 38, which tends to urge the upper portion 39 of locking member forwardly against the back of the pusher panel 31. Accordingly, when the bottom of the panel 31 is pushed rearwardly, the resisting action of the spring 30 can cause sufficient forward tilt on the panel and locking member to achieve the desired locking action at an intermediate position on the base wires 19-22. However, where the spring 30 is designed to have a relatively light force, perhaps insufficient to impart a tilt to the pusher panel 31, the user can manually squeeze together the lower portions of the front and rear pusher panels 31, 32, which automatically causes the front panel to tilt forwardly to achieve the desired locking action.

In the above described embodiment of the invention, the locking member 38 is separate from the product pusher 29, which has certain advantages in that locking members can be easily retrofitted into existing displays, without requiring storekeepers replace their existing inventory of trays. Thus, for converting existing displays, all that is required is to insert the locking member between the front and back panels 31, 32 of the pusher panel, in front of the spring 30.

Figure 11:
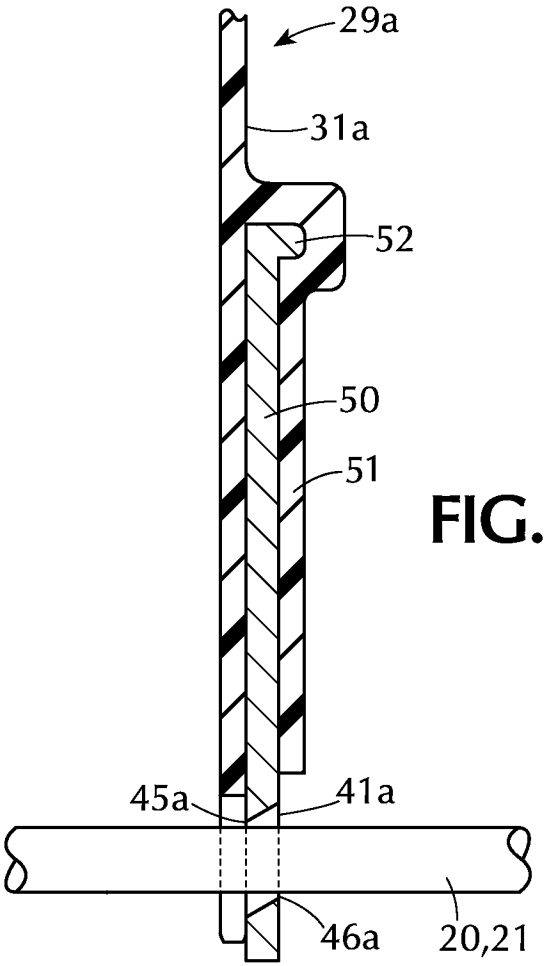
FIG. 11 is an enlarged, fragmentary cross sectional view showing portions of an alternative embodiment of the invention.

In a second embodiment of the invention, shown in FIG. 11, a locking member 50, formed of sheet steel or other suitably hard material, is fixed to the front panel 31*a* of a product pusher 29*a*, shown in part in FIG. 11. The product pusher 29*a* can be generally of the same configuration as the pusher 29 if the first embodiment, except that it is extruded with a pocket forming panel 51 spaced from the front panel 29*a* to closely receive the locking member 50. The locking member can be provided with a flange or the like 52 to secure the locking member in fixed vertical position with respect to the front panel 31*a*.

The illustrated form of the modified locking element 50 is of flat configuration. Accordingly the slot 41*a* formed in the lower portion thereof is disposed an angle to the principal vertical plane of the element 50, somewhat corresponding to the 26°-32° bend angle of the lower portion of the locking element 38 of the first described embodiment. The depth of the slot 41*a*, measured vertically, is somewhat greater than the diameter of the wires 20, 21 on which is it positioned, such that when the locking element is in a vertical orientation it can slide easily on the wires. However, if the pusher panel 31*a* and locking member 50 are tilted forward somewhat (e.g., 10°), the diagonally opposite edges 45*a*, 46*a* of the locking element will dig into the wires 20, 21 and lock the member 50 and panel 31*a* in a fixed position on the wires. Operation of the pusher 29*a* and its locking member 50 is otherwise generally as described with respect to the embodiment of FIGS. 1-10.

The invention, in any of its forms, is uniquely advantageous in providing for the ability to lock a product pusher in any retracted position on a wire base display tray, along with the ability to release the pusher for forward movement from the front of display. In many supermarkets, product displays can be extremely tight together, with little clearance at the sides and also above and below. In such cases, it can be very difficult, if indeed possible at all, to access the rear of a filled display in order to release a locked product pusher. With the arrangement of the invention, when a tray is fully restocked, insertion of the last package will automatically release the locked pusher. Otherwise, a rearward push on the front of the column of packages will effect the desired release.

Pursuant to the invention, the locking mechanism can be easily retrofitted into existing displays or inexpensively incorporated into the original manufacture. It solves a problem of long standing with respect to display trays with product pushers mounted on a wire base structure.

It should be understood, however, that the forms of the invention herein specifically illustrated and described are intended to be representative only and not limiting of the invention. Accordingly, reference should be made to the following appended claims in determining the full scope of the invention.

What is claimed is:

1. In a product display tray of the type having a base structure comprising a plurality of laterally spaced apart, longitudinally extending wire elements, a product pusher slideably supported on said wire elements for forward and rearward movement thereon, said product pusher having front and back panels having bottom portions normally longitudinally spaced apart a predetermined distance and being joined together at a distance above said bottom portions, and a spring element having a first portion positioned to act upon said front panel to urge said product pusher in a forward direction on said wire elements and a second portion connected to said tray, the improvement characterized by (a) a locking member associated with said front panel and having an opening therein with edge portions thereof positioned to engage one or more of said wire elements, (b) said front and back panels being joined in a manner such that, when the bottom portions thereof are resiliently deflected toward each other the front panel of said product pusher is caused to tilt in a forwardly direction, and (c) said locking member being so associated with said front panel that, when said front panel is tilted forwardly, said locking member is also caused or permitted to tilt whereby said edge portions of said opening lockingly engage said one or more wire elements to lock said locking member and front panel against forward movement.

2. A product display tray according to claim 1, wherein (a) said tiltable locking member is interposed between said spring element and said front panel whereby, when said locking member is lockingly engaging said one or more wire elements, said spring element is effectively prevented from urging said product pusher in a forward direction.

3. In a product display tray of the type having a base structure comprising a plurality of laterally spaced apart, longitudinally extending wire elements, a product pusher slideably supported on said wire elements for forward and rearward movement thereon, and a spring element having a first portion positioned to urge said product pusher in a forward direction on said wire elements and a second portion connected to said tray, the improvement characterized by (a) a tiltable locking member associated with said product pusher and operative in a first tilt condition to lock with one or more wire elements and prevent forward movement of said product pusher and in a second tilt condition to enable forward movement of said product pusher, (b) said product pusher having a product-engaging portion mounted on said wire elements for predetermined tilting movement to change the orientation thereof with respect to said wire elements, (c) said locking member being movable to its first tilt condition upon tilting movement of said product-engaging portion to a first tilt orientation and said locking member being tilted to its second tilt condition upon tilting movement of said product-engaging portion to a second tilt orientation, (d) said product pusher being formed with front and back panels movably joined at a junction level spaced above said wire elements, and (e) the length of said back panel, measured from said junction level to said wire elements, being greater than the length of said front panel from said junction level to said wire elements whereby, when lower portions of said panels are displaced toward each other, said front panel is caused to tilt forwardly to enable said locking member to be tilted into its first tilt position.

4. A product display tray according to claim 3, wherein (a) said front panel and said locking member are so related that, when said front panel is oriented in a substantially upright position, said locking member is retained in its second tilt position.

5. A product display tray according to claim 3, wherein (a) said product pusher is an extruded shape formed of a plastic material, (b) said back panel is integrally joined along a top edge thereof to a back of said front panel such that the length of said back panel is greater than a distance from the from said junction level to the bottom of said front panel.

6. A product display tray according to claim 5, wherein (a) said product pusher has an inverted Y-shaped configuration, with said back panel joined to said front panel below an upper edge of said front panel.

7. In a product display tray of the type having a base structure comprising a plurality of laterally spaced apart, longitudinally extending wire elements, a product pusher slideably supported on said wire elements for forward and rearward movement thereon, and a spring element having a first portion positioned to urge said product pusher in a forward direction on said wire elements and a second portion connected to said tray, the improvement characterized by (a) a tiltable locking member associated with said product pusher and operative in a first tilt condition to lock with one or more wire elements and prevent forward movement of said product pusher and in a second tilt condition to enable forward movement of said product pusher, (b) said product pusher having a product-engaging portion mounted on said wire elements for predetermined tilting movement to change the orientation thereof with respect to said wire elements, (c) said locking member being movable to its first tilt condition upon tilting movement of said product-engaging portion to a first tilt orientation and said locking member being tilted to its second tilt condition upon tilting movement of said product-engaging portion to a second tilt orientation, (d) said tiltable locking member being formed of sheet metal and has having an upper portion and a lower portion, (e) said upper portion being positioned directly behind and in contact with the product-engaging portion of said pusher, and said lower portion having an opening receiving said one or more wire elements, (f) said opening having upper and lower wire-engaging edges grippingly engaging said one or more wire elements when said lower portion is disposed at a predetermined tilt angle, and (g) said spring element being positioned to act forwardly upon said upper portion of said tiltable locking member.

8. A product display tray according to claim 7, wherein (a) a front surface of the lower portion of said locking member is disposed at an acute angle with respect to a front surface of said upper portion of said locking member.

9. A product display tray according to claim 7, wherein (a) the opening in said lower portion of said locking member is a horizontally elongated slot of a width to receive a pair of laterally adjacent wire elements, (b) said horizontally elongated slot has a downwardly opening entrance gap of less width than a distance between said laterally adjacent wire elements but of sufficient width to enable said laterally adjacent wire elements to be received into said horizontal slot through said downwardly opening entrance gap when portions of said laterally adjacent wire elements are temporarily displaced toward each other.

10. A product display tray according to claim 7, wherein (a) said spring element is a coiled strip spring anchored at a front portion of said tray and having a coil portion engaging a back surface of the upper portion of said tiltable locking member.

11. A product display tray according to claim 7, wherein (a) said opening in the lower portion of said locking member has a vertical dimension greater than a diameter of said wire elements and defines corner edges at upper front and lower rear corners of said opening to lockingly engage with said wire elements when said locking member is tilted forwardly.

12. A product display tray according to claim 11, wherein (a) the vertical dimension of said opening and the vertical and horizontal spacing of said corner edges is such that said corner edges will lockingly engage with said wire elements when the upper portion of said locking member is tilted forwardly about 10 degrees from a normal orientation.

* * * * *